US008387792B2

(12) United States Patent
Chen

(10) Patent No.: US 8,387,792 B2
(45) Date of Patent: Mar. 5, 2013

(54) SLEEVE KIT WITH SLEEVE BRACKETS

(76) Inventor: Kun-Chen Chen, Taichung (TW)

( * ) Notice: Subject to any disclaimer, the term of this patent is extended or adjusted under 35 U.S.C. 154(b) by 0 days.

(21) Appl. No.: 13/151,347

(22) Filed: Jun. 2, 2011

(65) Prior Publication Data

US 2012/0305412 A1 Dec. 6, 2012

(51) Int. Cl.
*B65D 85/28* (2006.01)

(52) U.S. Cl. ..... 206/378; 206/1.5

(58) Field of Classification Search ..... 206/1.5, 206/372, 373, 377–379, 807; 211/70.6
See application file for complete search history.

(56) References Cited

U.S. PATENT DOCUMENTS 5,975,297 A * 11/1999 Kao ..... 206/378
6,092,656 A * 7/2000 Ernst ..... 206/378
6,098,799 A * 8/2000 Lee ..... 206/378
6,644,474 B1 * 11/2003 Lai ..... 206/378
6,669,032 B2 * 12/2003 Kao ..... 211/70.6
7,306,099 B2 * 12/2007 Chen ..... 206/379
7,434,688 B2 * 10/2008 Hu ..... 206/377
2008/0128370 A1 * 6/2008 Shih ..... 211/70.6
2012/0043238 A1 * 2/2012 Christopher ..... 206/375

* cited by examiner

*Primary Examiner* — Bryon Gehman
(74) *Attorney, Agent, or Firm* — Alan Kamrath; Kamrath IP Lawfirm, P.A.

(57) ABSTRACT

A sleeve kit has a case, multiple sleeves and a cover. The case has multiple sleeve brackets and multiple fasteners. Each fastener is mounted on a position between two adjacent ones of the sleeve brackets, protrudes from a plane where openings of the sleeve brackets are located and has two barbs and a gap. The cover covers the sleeve brackets and has multiple secure holes respectively mounted around the fasteners. With the secure holes mounted around the fasteners, the cover is difficult to be removed from the case, and the sleeves are protected against burglars.

16 Claims, 6 Drawing Sheets

SLEEVE KIT WITH SLEEVE BRACKETS

BACKGROUND OF THE INVENTION

1. Field of the Invention

The present invention relates to a sleeve kit and, more particularly, to a sleeve kit having an excellent burglarproof function.

2. Description of Related Art

With regard to a conventional sleeve kit, multiple sleeves are embedded in a mattress placed in a toolbox or are inserted into a plastic case.

However, the toolbox or the case is easily opened due to the sleeve kit's lack of a burglarproof structure, and some of the sleeves are easily stolen when on display at the retailer. If any one of the sleeves is stolen, the whole sleeve kit is no longer suitable for sale, and a great loss is incurred to the retailer.

To overcome the shortcomings, the present invention tends to provide a sleeve kit to mitigate the aforementioned problems.

SUMMARY OF THE INVENTION

The main objective of the invention is to provide a sleeve kit having an excellent burglarproof function.

A sleeve kit has a case, multiple sleeves and a cover. The case has multiple sleeve brackets and multiple fasteners. Each fastener is mounted on a position between two adjacent ones of the sleeve brackets, protrudes from a plane where openings of the sleeve brackets are located and has two barbs and a gap. The cover covers the sleeve brackets and has multiple secure holes respectively mounted around the fasteners. With the secure holes mounted around the fasteners, the cover is difficult to be removed from the case, and the sleeves are protected against burglars.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
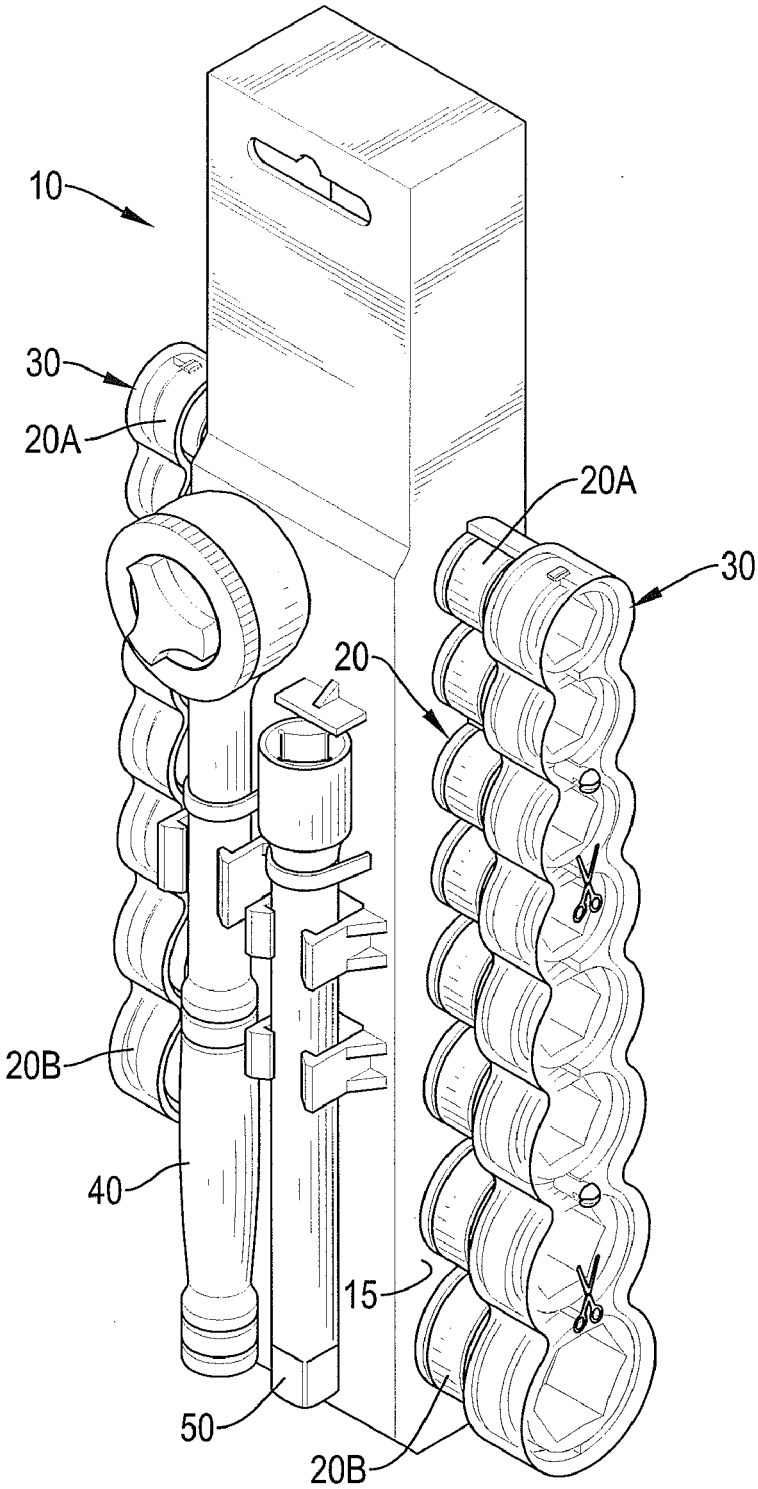
FIG. 1 is a perspective view of a sleeve kit in accordance with the present invention.
Figure 2:
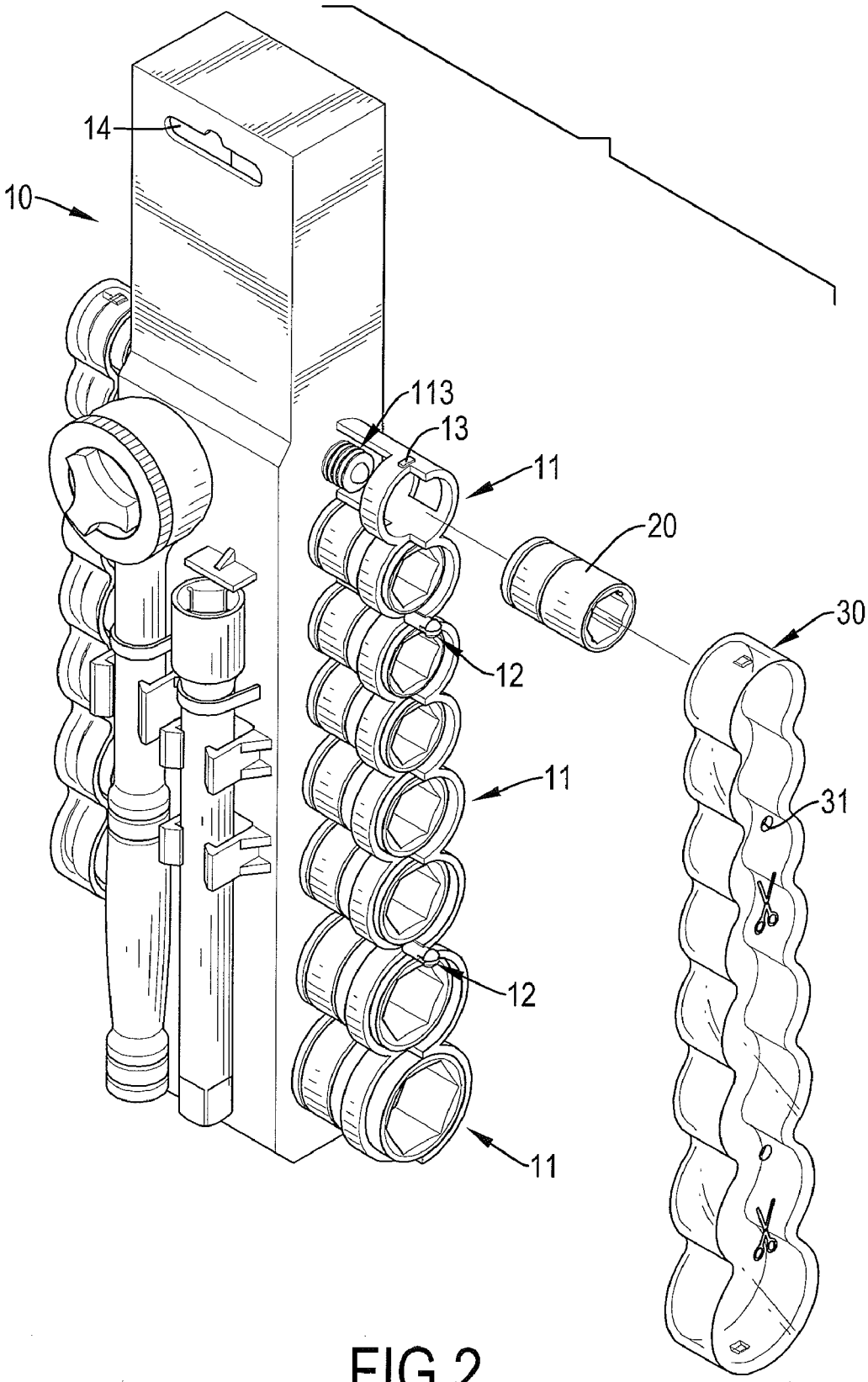
FIG. 2 is a partially exploded perspective view of the sleeve kit in FIG. 1.
Figure 3:
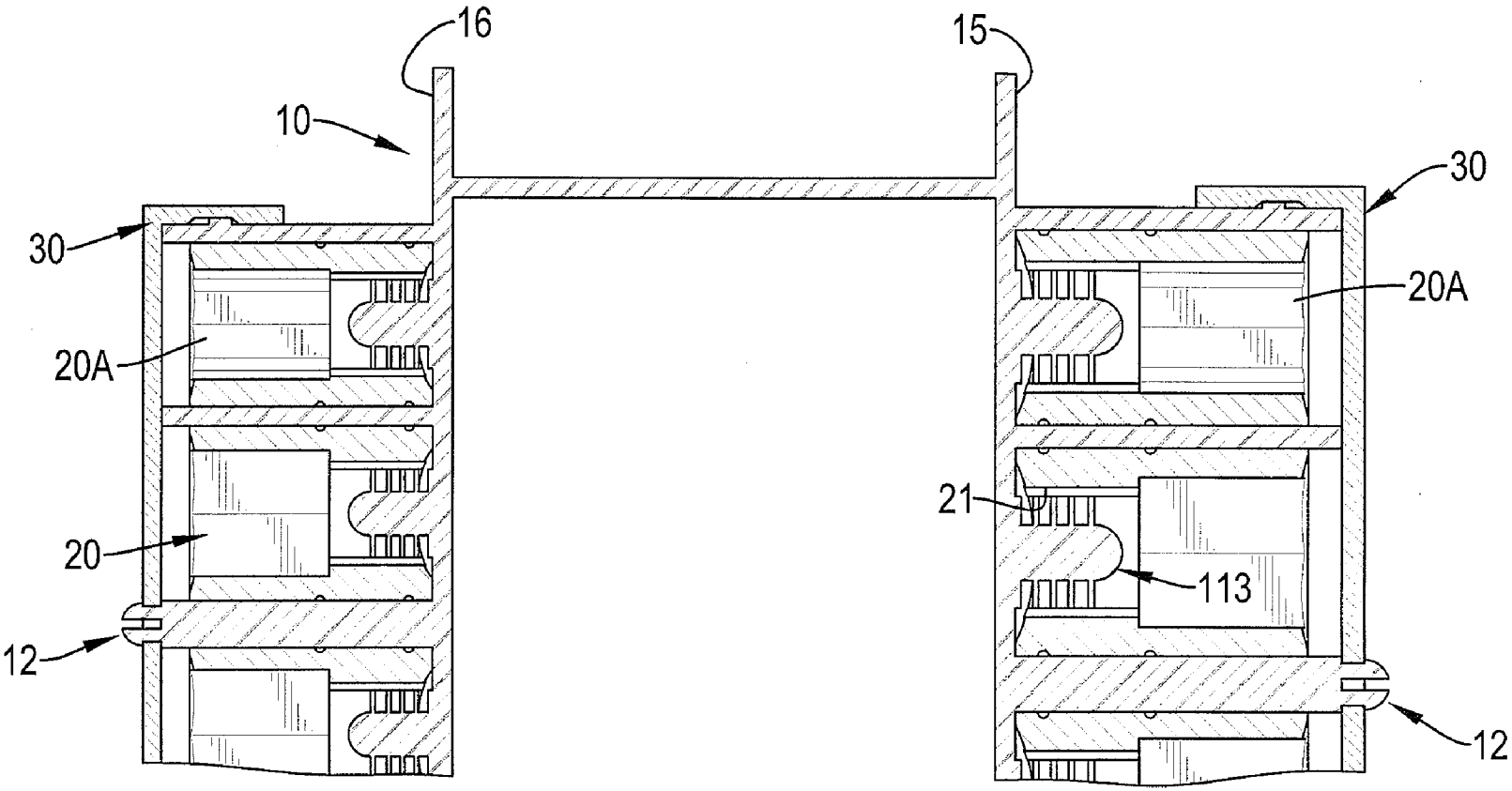
FIG. 3 is a side view in partial section of the sleeve kit in FIG. 1.

With reference to FIGS. 1 to 3, a sleeve kit in accordance with the present invention comprises a case 10, multiple sleeves 20, two covers 30, a wrench 40 and an extended rod 50.

The case 10 has a top, a first flank 15, a second flank 16, a front surface and two positioning units. The first flank 15 is opposite to the second flank 16. The positioning units are respectively defined as a first positioning unit and a second positioning unit. The first positioning unit protrudes from the first flank 15, and the second positioning unit protrudes from the second flank 16. Each positioning unit has multiple hollow sleeve brackets 11, multiple fasteners 12 and two bulges 13. Two of the sleeve brackets 20 respectively located at two ends of each flank 15, 16 of the case 10 are respectively defined as a first sleeve bracket 20A and a second sleeve bracket 20B.

Figure 4:
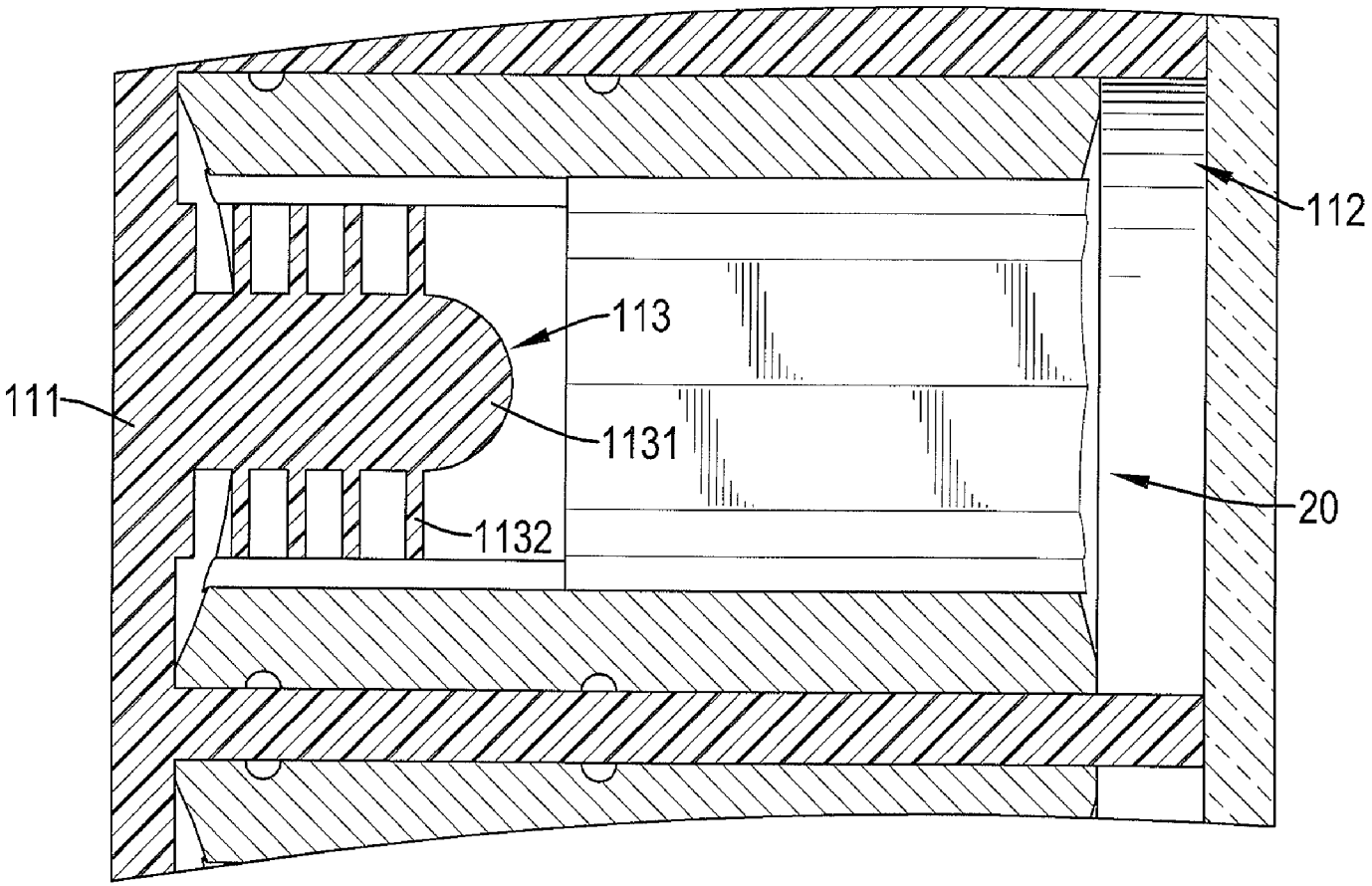
FIG. 4 is an enlarged side view of the sleeve kit in FIG. 3, showing the plug section.

With reference to FIGS. 2 to 4, each sleeve bracket 11 has a bottom 111, an opening 112 and a plug section 113. The opening 112 of each sleeve bracket 11 is opposite to the bottom 111 of the sleeve bracket 11. The plug section 113 of each sleeve bracket 11 is axially mounted on the bottom 111 of the sleeve bracket 11, protrudes toward the opening 112 of the sleeve bracket 11 and has a rod 1131 and multiple rings 1132. The rings 1132 of each plug section 113 are mounted securely around the rod 1131 of the plug section 113.

Figure 5:
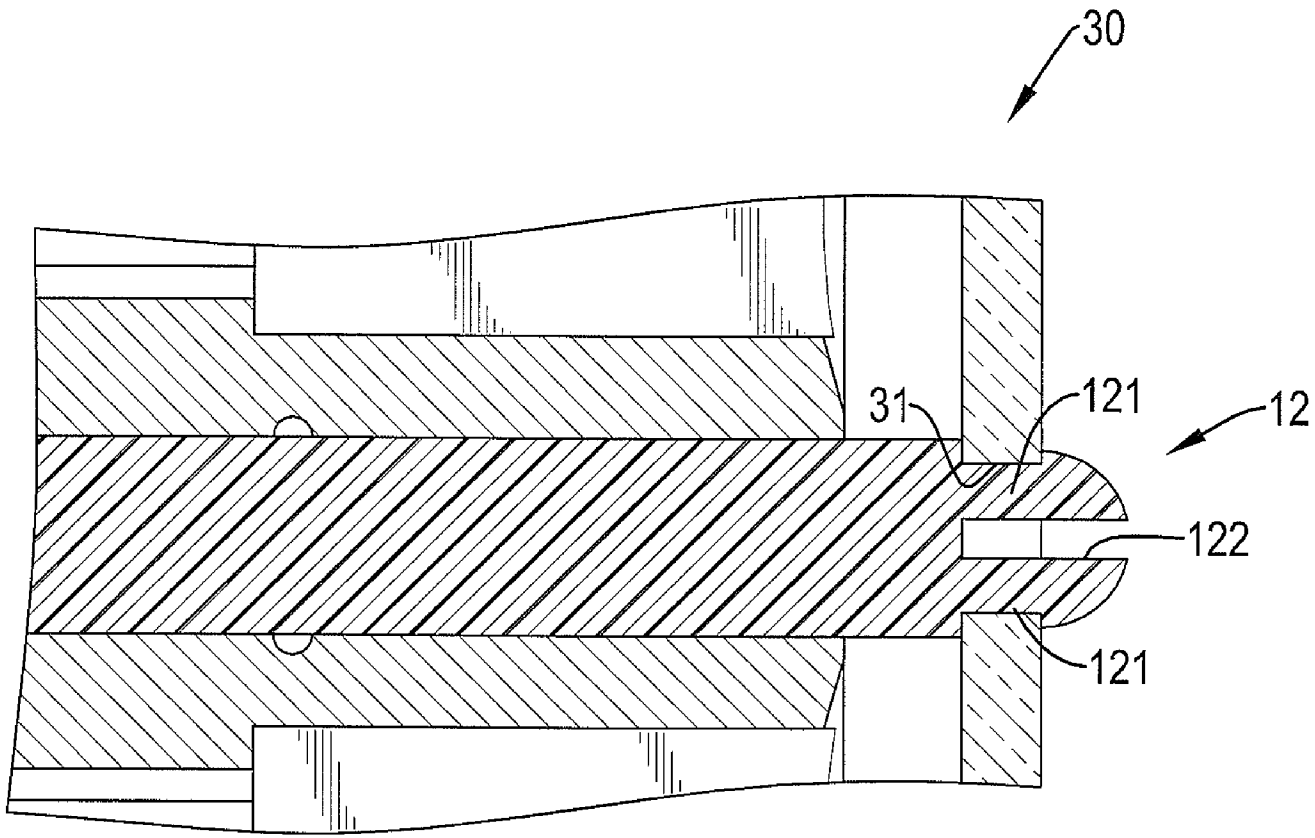
FIG. 5 is an enlarged side view of the sleeve kit in FIG. 3, showing the fastener.

With reference to FIGS. 2, 3 and 5, two fasteners 12 of each positioning unit are implemented. Each fastener 12 is mounted securely on a position between two adjacent ones of the sleeve brackets 11, protrudes from a plane where the openings 112 of the sleeve bracket 11 are located and has two barbs 121 and a gap 122. The gap 122 of each fastener 12 is formed between the barbs 121 of the fastener 12.

Figure 6:
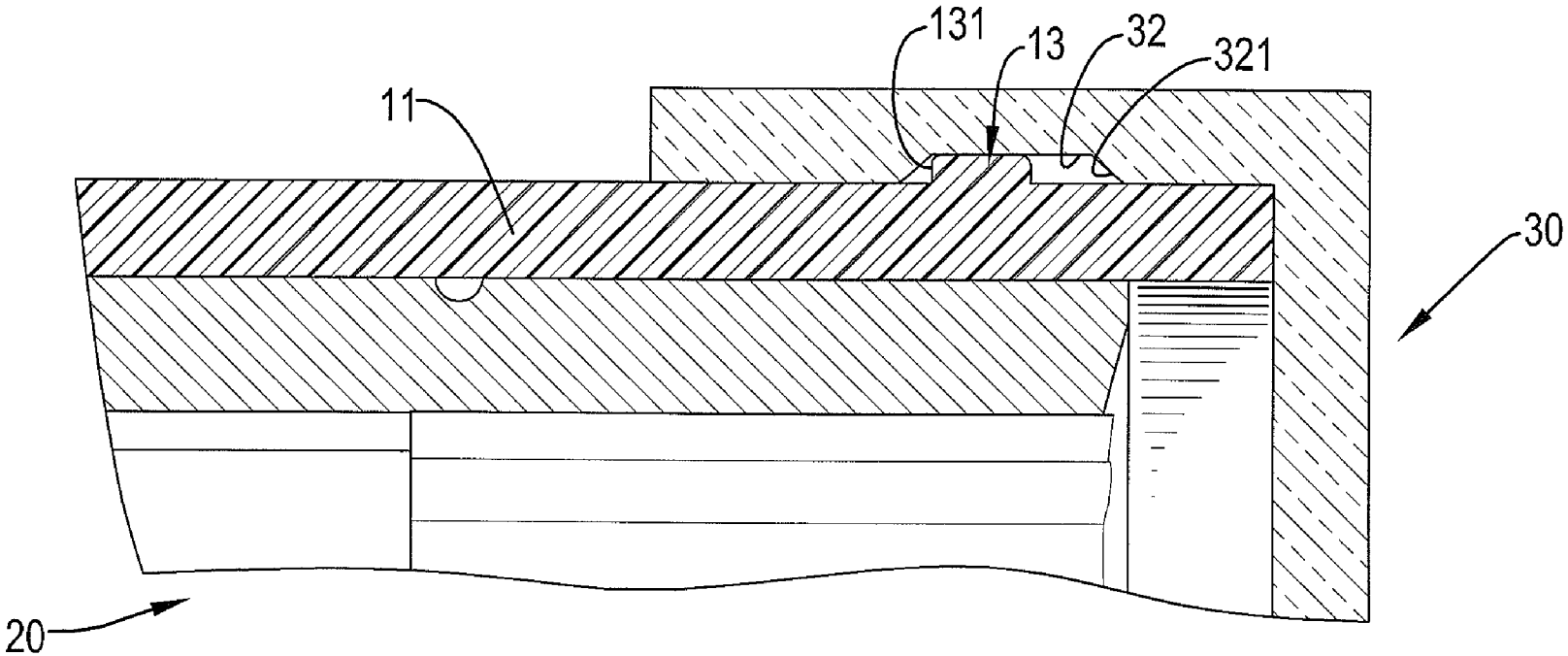
FIG. 6 is an enlarged side view of the sleeve kit in FIG. 3, showing the bulge.

With further reference to FIG. 6, the bulges 13 of each positioning unit are respectively mounted on the first sleeve bracket 20A and the second sleeve bracket 20B of a corresponding one of the positioning units. Preferably, each bulge 13 has a rectangular cross section, a flat side surface and a limiting surface 131 formed on the side surface of the bulge 13.

Preferably, the case 10 has a hanging hole 14 formed through the top of the case 10.

With reference to FIGS. 2 to 4, the sleeves 20 are respectively mounted in the sleeve brackets 11. Each sleeve 20 has a sleeve hole 21 mounted around one of the plug sections 113 and having a rectangular cross section. With friction between the rings 1132 and inner surfaces of the sleeve holes 21, the sleeves 20 do not easily fall off from the case 10, and to take off the sleeves, the user must apply a force.

The sleeves 20 may be conventional and detailed description is omitted.

With reference to FIGS. 2, 5 and 6, the covers 30 respectively cover the positioning units. Each cover 30 covers the sleeve brackets 11 and has two secure holes 31 and two cavities 32. The secure holes 31 of each cover 30 are formed through the cover 30 and are respectively mounted around the fasteners 12. The cavities 32 of each cover 30 encompass respectively the bulges 13.

Preferably, each cavity 32 has a trapezoidal cross section, two opposite inner surfaces and two inclined guiding surfaces 321 respectively formed on the inner surfaces of the cavity 32. Accordingly, the guiding surfaces 321 guide the bulges 13 to easily slide into and retract from the cavities 32.

After the sleeve kit in accordance with the present invention is purchased by a consumer, sections of the barbs 121 exposed outside the covers 30 are required to be cut off by a scissor. Therefore, the covers 30 can easily cover or be removed from the positioning units.

With reference to FIG. 1, the wrench 40 and the extended rod 50 are mounted on the front surface of the case 10. The wrench 40 and the extended rod 50 may be conventional, and detailed description is omitted.

From the above description, it is noted that the present invention has the following advantages:

1. Burglarproof Function:

With the secure holes 31 mounted around the fasteners 12, the covers 30 are difficult to be removed from the case 10, and the sleeves 20 are protected against burglars.

2. Secure Positioning of the Sleeves 20:

With friction between the rings 1132 and inner surfaces of the sleeve holes 21, the sleeves 20 do not easily fall off from the case 10 and are positioned securely.

3. Protection of the Sleeves 20 from Falling Off:

Because the cavities 32 encompass the bulges 13, the covers 30 are easily covered on the sleeves and positioned on the case 10, and the sleeves 20 can be further protected from falling off.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sleeve kit comprising:

a case having a first flank;

multiple hollow sleeve brackets protruding from the first flank of the case, wherein two of the sleeve brackets respectively located at two ends of the first flank of the case are respectively defined as a first sleeve bracket and a second sleeve bracket, with each sleeve bracket having a bottom;

an opening opposite to the bottom of the sleeve bracket; and a plug section axially mounted on the bottom of the sleeve bracket, protruding toward the opening of the sleeve bracket, and having a rod and multiple rings mounted securely around the rod;

a fastener mounted securely on a position between two adjacent ones of the sleeve brackets and protruding from a plane where the openings of the sleeve brackets are located, with the fastener having two barbs; and a gap formed between the barbs; and two bulges respectively mounted on the first sleeve bracket and the second sleeve bracket, and opposite to each other;

multiple sleeves respectively mounted in the sleeve brackets, with each sleeve having a sleeve hole mounted around one of the plug sections; and a cover covering the sleeve brackets and having a secure hole formed through the cover and mounted around the fastener; and two cavities respectively encompassing the two bulges.

2. The sleeve kit as claimed in claim 1, wherein the case has a top and a hanging hole formed through the top of the case.

3. The sleeve kit as claimed in claim 2, wherein the sleeve brackets are defined as a positioning unit;

the case has a second flank opposite to the first flank of the case;

the sleeve kit further has multiple sleeve brackets protruding from the second flank of the case and defined as a second positioning unit;

a structure of the first positioning unit is the same as that of the second positioning unit; and the sleeve kit further has a cover covering the second positioning unit.

4. The sleeve kit as claimed in claim 3, wherein the case has a front surface; and wherein the sleeve kit has a wrench and an extended rod respectively mounted on the front surface of the case.

5. The sleeve kit as claimed in claim 4, wherein each bulge has a rectangular cross section, a flat side surface and a limiting surface formed on the side surface of the bulge; and each cavity has a trapezoidal cross section, two opposite inner surfaces and two inclined guiding surfaces respectively formed on the inner surfaces of the cavity.

6. The sleeve kit as claimed in claim 3, wherein each bulge has a rectangular cross section, a flat side surface and a limiting surface formed on the side surface of the bulge; and each cavity has a trapezoidal cross section, two opposite inner surfaces and two inclined guiding surfaces respectively formed on the inner surfaces of the cavity.

7. The sleeve kit as claimed in claim 2, wherein the case has a front surface; and wherein the sleeve kit has a wrench and an extended rod respectively mounted on the front surface of the case.

8. The sleeve kit as claimed in claim 7, wherein each bulge has a rectangular cross section, a flat side surface and a limiting surface formed on the side surface of the bulge; and each cavity has a trapezoidal cross section, two opposite inner surfaces and two inclined guiding surfaces respectively formed on the inner surfaces of the cavity.

9. The sleeve kit as claimed in claim 2, wherein each bulge has a rectangular cross section, a flat side surface and a limiting surface formed on the side surface of the bulge; and each cavity has a trapezoidal cross section, two opposite inner surfaces and two inclined guiding surfaces respectively formed on the inner surfaces of the cavity.

10. The sleeve kit as claimed in claim 1, wherein the sleeve brackets on the first flank of the case are defined as a first positioning unit;

the case has a second flank opposite to the first flank of the case;

the sleeve kit further has multiple sleeve brackets protruding from the second flank of the case and defined as a second positioning unit;

a structure of the first positioning unit is the same as that of the second positioning unit; and the sleeve kit further has a cover covering the second positioning unit.

11. The sleeve kit as claimed in claim 10, wherein the case has a front surface; and wherein the sleeve kit has a wrench and an extended rod respectively mounted on the front surface of the case.

12. The sleeve kit as claimed in claim 11, wherein each bulge has a rectangular cross section, a flat side surface and a limiting surface formed on the side surface of the bulge; and each cavity has a trapezoidal cross section, two opposite inner surfaces and two inclined guiding surfaces respectively formed on the inner surfaces of the cavity.

13. The sleeve kit as claimed in claim 10, wherein each bulge has a rectangular cross section, a flat side surface and a limiting surface formed on the side surface of the bulge; and each cavity has a trapezoidal cross section, two opposite inner surfaces and two inclined guiding surfaces respectively formed on the inner surfaces of the cavity.

14. The sleeve kit as claimed in claim 1, wherein the case has a front surface; and wherein the sleeve kit has a wrench and an extended rod respectively mounted on the front surface of the case.

15. The sleeve kit as claimed in claim 14, wherein each bulge has a rectangular cross section, a flat side surface and a limiting surface formed on the side surface of the bulge; and each cavity has a trapezoidal cross section, two opposite inner surfaces and two inclined guiding surfaces respectively formed on the inner surfaces of the cavity.

16. The sleeve kit as claimed in claim 1, wherein each bulge has a rectangular cross section, a flat side surface and a limiting surface formed on the side surface of the bulge; and each cavity has a trapezoidal cross section, two opposite inner surfaces and two inclined guiding surfaces respectively formed on the inner surfaces of the cavity.

* * * * *